United States Patent [19]
Porenski et al.
[11] 4,452,260
[45] Jun. 5, 1984

[54] TOBACCO PASTE CIGARETTE ADDITIVE AND CIGARETTE HAVING SAME

[75] Inventors: Harry S. Porenski; Leroy R. Sachleben, both of Louisville, Ky.

[73] Assignee: Brown & Williamson Tobacco Corporation, Louisville, Ky.

[21] Appl. No.: 365,701

[22] Filed: Apr. 5, 1982

[51] Int. Cl.³ ..... A24B 3/18; A24C 5/14; A24D 1/00

[52] U.S. Cl. ..... 131/364; 131/291; 131/293; 131/84 R

[58] Field of Search ..... 131/292, 291, 365, 363, 131/364, 84 R, 293

[56] References Cited

U.S. PATENT DOCUMENTS 3,223,090 12/1965 Strub et al. ..... 131/292

FOREIGN PATENT DOCUMENTS 1331640 9/1973 United Kingdom ..... 131/291

*Primary Examiner*—Vincent Millin
*Attorney, Agent, or Firm*—Charles G. Lamb

[57] ABSTRACT

A processed expandable tobacco paste as an additive to a cigarette, and a cigarette having the tobacco paste is disclosed. The tobacco paste provides a cigarette with the physical properties of firmness of tobacco, even tobacco burning, draw resistance, cigarette end stability and coal retention of conventional cigarettes, but at a lower tobacco density than conventional cigarettes. The cigarette includes a cylindrical tobacco rod, at least one longitudinally extending line of expanded tobacco paste, and wrapping material circumferentially surrounding the tobacco rod which compresses the relatively low density tobacco rod. The tobacco paste can also contain a flavoring ingredient.

14 Claims, 5 Drawing Figures

TOBACCO PASTE CIGARETTE ADDITIVE AND CIGARETTE HAVING SAME

BACKGROUND OF THE INVENTION

1. Field of the Invention

The present invention relates generally to cigarettes. In one respect it relates to a cigarette additive for providing a cigarette with the physical properties of tobacco firmness, retention of the tobacco at the ends of the cigarette, and coal retention corresponding to that of conventional cigarettes, but at a lower tobacco density than conventional cigarettes. In another respect, the present invention relates to a process for making a cigarette having the cigarette additive, and in a further respect to a cigarette including the additive.

2. Description of the Prior Art

It is well known to form a paste of tobacco as a step in the manufacture of cigarettes. For example, U.S. Pat. No. 217,767 issued on July 22, 1879 to John W. Bolles is directed to a paper wrapper which resembles a natural leaf wrapper in appearance and pliability. The wrapper is composed of a paper coated with a paste formed of tobacco, water and glycerine. U.S. Pat. No. 2,656,841 issued on Oct. 27, 1953 to Martin H. Gurley is directed to a tobacco sheet material to be used in the manufacture of a smoking article which is formed of expanded or puffed reconstituted tobacco. The tobacco sheet is composed of tobacco stems, dust, scrap and clippings which would otherwise not be used. The tobacco sheet fabricated of these tobacco portions is comminuted and mixed with water to form a slurry. The tobacco slurry is placed in a ball mill to hydrate or gelatinize the tobacco particles. The gelatinized tobacco is formed into a sheet and hot air is passed over the sheet to remove excess moisture. The sheet is next heated to suddenly vaporize the remaining moisture in the tobacco sheet to puff the sheet. The sheet is then shredded and added to other tobacco for making cigarettes. U.S. Pat. No. 3,223,090 issued on Dec. 14, 1965 to David G. Strubel and Charles J. Moll is directed to an improved method of forming a reconstituted tobacco sheet of stems, fines and the like. The tobacco particles are slurried in water into a paste which is freeze dried to remove excess moisture. U.S. Pat. No. 3,373,751 issued on Mar. 19, 1968 to A. Wallberg is directed to manufacturing a tobacco rod of reconstituted tobacco. Waste tobacco particles such as stems, dust, and the like, are mixed with water, and the slurry is milled in the presence of an inert gas to produce a paste. The paste is extruded to form a tobacco rod.

SUMMARY OF THE INVENTION

The present invention provides an expandable tobacco paste usable as a cigarette additive, and a cigarette having the same, which provides a cigarette with a tobacco column or rod of lower tobacco density than a more conventional cigarette, but having physical properties such as tobacco firmness, tobacco stability at the cigarette ends, and coal retention corresponding to a more conventional cigarette.

A firm tobacco rod is a desirable feature in a cigarette for a number of reasons. For example, a firm tobacco rod gives a pleasing, neat appearance to the cigarette, provides cigarette end stability so that tobacco will not readily spill out of the end of the cigarette, and contributes to an even burning of the cigarette.

The present invention recognizes the desirability of a firm tobacco rod and accomplishes this result using a tobacco rod of lower tobacco density than in conventional cigarettes.

More particularly, the present invention provides a cigarette comprising a generally cylindrical rod of tobacco including at least one line of expanded tobacco paste extending substantially longitudinally of the tobacco rod, and a wrapper material circumferentially surrounding the tobacco rod and at least one line of expanded tobacco paste.

Further, the present invention provides an expandable tobacco paste for use as an additive to cigarettes comprising a slurry of comminuted tobacco material and a rising component.

BRIEF DESCRIPTION OF THE DRAWINGS

A better understanding of the present invention will be had upon reference to the accompanying specification and drawings in which like numerals refer to like components throughout the several views, and wherein.

DESCRIPTION OF THE PREFERRED EMBODIMENT

Figure 1:
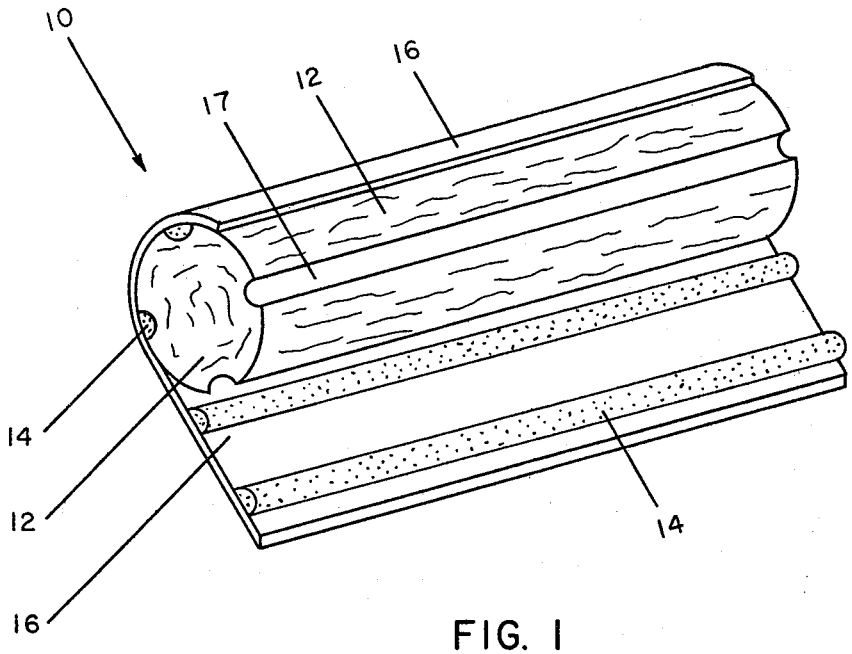
FIG. 1 is a perspective view of a cigarette embodying the present invention with the wrapper partially unwound to more clearly show details.
Figure 2:
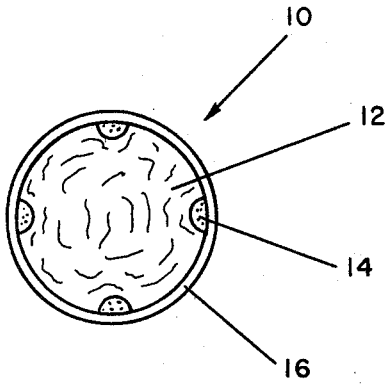
FIG. 2 is an end view of the cigarette of FIG. 1.

With reference to FIGS. 1 and 2, there is illustrated a cigarette 10 having the various features of the present invention. It should be clearly understood that, while the illustrated embodiment of the cigarette 10 is shown as a non-filtered cigarette, it is within the purview of the invention that it can be used with a filter cigarette with equally advantageous results.

The cigarette 10, whether it be a filtered or non-filtered cigarette, comprises a generally cylindrically shaped tobacco rod 12 of high quality tobacco. The cigarette 10 further comprises at least one line of expanded tobacco paste 14 disposed along the surface of the tobacco rod 12 and extends substantially longitudinally of the tobacco rod 12. As shown in FIGS. 1 and 2, at least one line of paste comprises four lines of expanded paste 14 substantially equally spaced from each other around the circumference of the tobacco rod, each of which extends substantially the entire length of the tobacco rod 12. A wrapper material 16, such as porous or non-porous paper, circumferentially surrounds the tobacco rod 12 and covers the expanded paste lines 14. The expanded lines of tobacco paste 14 compress the tobacco rod 12 thus allowing the use of a tobacco rod of lower tobacco density than in conventionally constructed cigarettes. The channels denoted by the number 17 depict indentations formed in the tobacco rod 12 by the expanded paste lines 14.

The expandable tobacco paste comprises a slurry of tobacco material such as, for example, tobacco stems, dust, scrap and clippings, and a rising or puffing component such as, for example, bicarbonate of soda. The tobacco material is comminuted to a desired size and slurried in water with the rising material.

In addition to the rising material, it is contemplated that a flavoring ingredient can also be included in the expandable tobacco paste. An example of one such flavoring ingredient is, for example, menthol.

Figure 3:
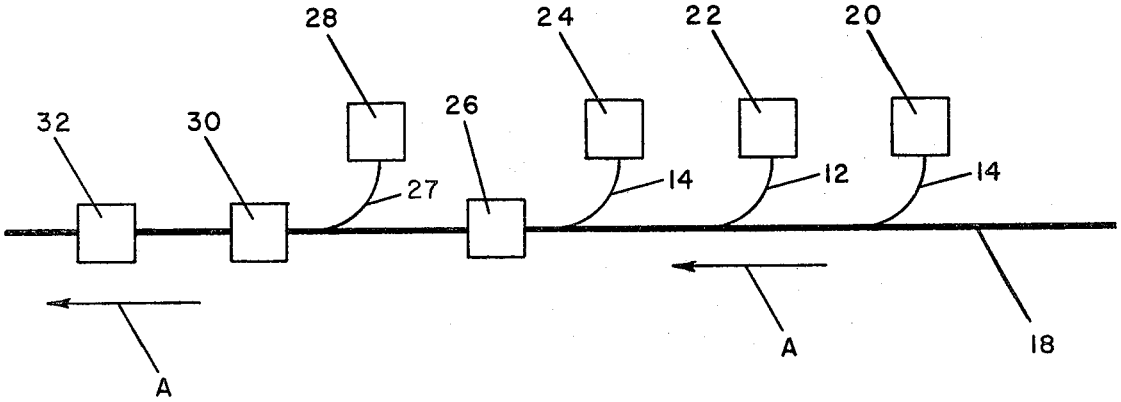
FIG. 3 is a schematic representation illustrating the various steps in the manufacture of the cigarette embodying the present invention as shown in FIG. 1.

FIG. 3 schematically represents a manufacturing process for making the cigarette 10. As shown, at least one line of expandable tobacco paste 14 is applied to a continuously moving web of cigarette wrapper paper 18 as the web 18 moves through a work station 20. The direction of movement of the web 18 is denoted by the flow arrows "A". The tobacco comprising the tobacco rod 12 is fed onto the moving web 18 overlaying the line of expandable tobacco paste as the web 18 moves through a work station 22. Additional lines of expandable tobacco paste 14 are applied to the tobacco rod 12 as the tobacco rod and web 18 of wrapper material move through a work station 24. The web 18 is partially folded circumferentially about the tobacco rod as they move together through an initial folding station 26. An adhesive 27 is applied to one edge of the web 18 of wrapper material as the web passes from the initial folding station 26 through an adhesive application station 28. The partially wrapped tobacco rod moves from the adhesive application station 28 through a final fold station 30 where upon the web 18 is folded to circumferentially enclose the tobacco rod. The now wrapped tobacco rod progresses through a heating station 32 wherein the expandable lines of tobacco paste are heated and caused to expand compressing the tobacco column to the desired degree. After the wrapped tobacco rod passes from the heating station, it is cut into cigarette sized lengths.

Figure 4:
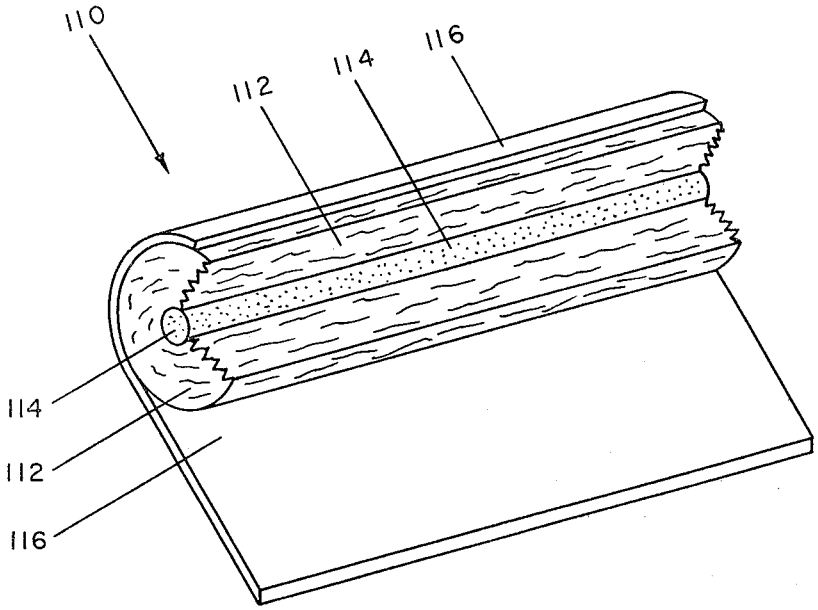
FIG. 4 is a perspective view of another embodiment of the present invention with the wrapper partially unwound and selected positions cut-away; and, FIG. 5 is a schematic representation illustrating the various steps in the manufacture of the cigarette of FIG. 4.

FIG. 4 illustrates another advantageous embodiment of a cigarette 110 which may also be either a filtered or non-filtered cigarette. The cigarette 110 comprises a generally cylindrically shaped tobacco rod 112 of high quality tobacco with at least one line of expanded tobacco paste 114 generally centrally disposed within the tobacco rod 112. As shown, the line of expanded tobacco paste 114 is generally concentrically located within the tobacco rod 112 and extends substantially the entire length of the tobacco rod. A wrapper material 116, such as porous or non-porous paper, circumferentially surrounds the tobacco rod 112. The expanded line of tobacco paste 114 generally radially compresses the tobacco rod between it and the wrapper 116 thus allowing the use of a tobacco rod of lower tobacco density than in conventionally constructed cigarettes.

Figure 5:
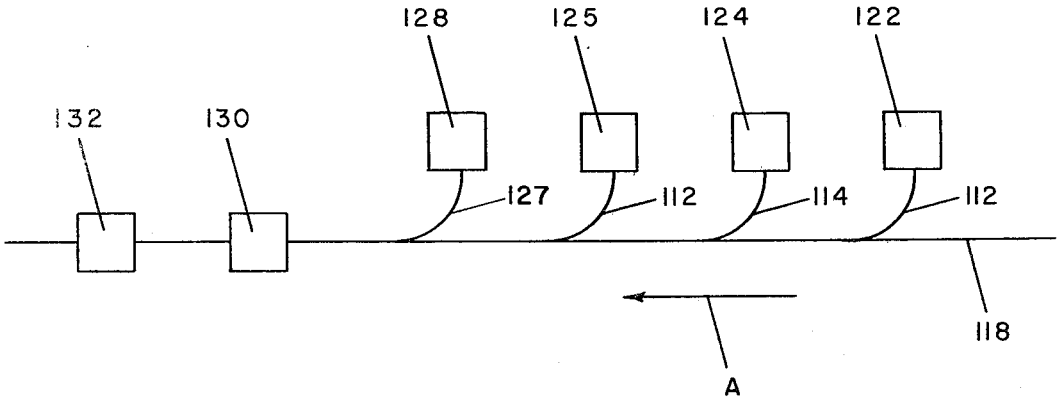

FIG. 5 schematically represents a manufacturing process for making the cigarette 110. As shown, a bed of tobacco comprising the tobacco rod 112 is fed onto a moving web of cigarette wrapper paper 118 as the web 118 moves in a direction indicated by the arrow "A" through a work station 122. At least one line of expandable tobacco paste 114 is next applied to the top surface of the tobacco bed as the tobacco bed and web of wrapper paper move through a work station 124. After the application of the line of expandable tobacco paste to the tobacco bed, additional tobacco also comprising the tobacco rod 112 is applied over the tobacco bed and at least one line of expandable tobacco paste as the tobacco bed and web 118 move through a work station 125. An adhesive 127 is applied to the web 118 of wrapper material as it passes from the work station 125 through an adhesive application station 128. The web 118 of wrapper material, carrying the tobacco and paste 114 next moves through a fold station 130 where the web 118 is folded to circumferentially enclose the tobacco rod. The wrapped tobacco rod progresses through a heating station 132 wherein the expandable line of tobacco paste 114 is heated and caused to expand compressing the tobacco rod to the desired degree. After passing from the heating station, the wrapped tobacco rod is cut into cigarette sized lengths.

With continued reference to FIGS. 3 and 5, the work station 20, 24, 124 can be a heated paste extruder. The heated tobacco paste extruder is used to control the shape and density of the tobacco paste line 14, 114, expand the tobacco paste line before it is applied to the web of wrapper paper 18, 118 and to apply the expanded tobacco paste line to the web of wrapper paper. Using this process, the heating station 32, 132 can be eliminated.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cigarette comprising:

a generally cylindrical rod of tobacco including;

at least one line of expanded tobacco paste extending substantially longitudinally of said tobacco rod; and, a wrapper material circumferentially surrounding said tobacco rod and said at least one line of expanded tobacco paste.

2. The cigarette of claim 1 wherein said at least one line of expanded tobacco paste extends along the outer surface of said tobacco rod.

3. The cigarette of claim 1 wherein said at least one line of expanded tobacco paste is centrally disposed of said tobacco rod.

4. The cigarette of claim 1, wherein said at least one line of expanded tobacco paste extends longitudinally substantially the entire length of said generally cylindrical tobacco rod.

5. The cigarette of claim 1, wherein said at least one line of expanded tobacco paste comprises a plurality of lines of expanded tobacco paste generally equally spaced from each other about the circumference of said generally cylindrical tobacco rod.

6. The cigarette of claim 1, wherein said tobacco paste comprises:

comminuted tobacco material; and, a rising component.

7. The cigarette of claim 6, wherein said rising component is:

Bicarbonate of soda.

8. The cigarette of claim 1, wherein said expanded tobacco paste comprises a flavoring ingredient.

9. A process of manufacturing a cigarette comprising the steps of:

forming an expandable tobacco paste comprised of tobacco material and a rising component;

applying at least one line of said expandable tobacco paste to a moving web of wrapping material;

supplying a generally cylindrical tobacco rod in overlaying relationship to said at least one expandable paste line on said web of wrapping material;

folding said web of wrapping material circumferentially around said tobacco rod; and, expanding said at least one line of expandable tobacco paste.

10. The process of claim 9, comprising the further step of applying at least one line of expandable tobacco paste to said tobacco rod before folding said web of wrapping material circumferentially around said tobacco rod.

11. A process of manufacturing a cigarette comprising the steps of:

forming an expandable tobacco paste comprised of tobacco material and a rising component;

disposing a bed of tobacco on a moving web of wrapping material;

applying at least one line of said expandable tobacco paste to the bed of tobacco moving with the web of wrapping material;

folding said web of wrapping material to enclose said tobacco bed; and, expanding said at least one line of expandable tobacco paste.

12. The process of claim 11, comprising the further step of applying additional tobacco over said bed of tobacco after said at least one line of expandable tobacco paste has been applied to said bed of tobacco.

13. A process of manufacturing a cigarette comprising the steps of:

forming an expandable tobacco paste of tobacco material and a rising component;

concurrently expanding said expandable tobacco paste and extruding at least one line of expanded tobacco paste;

applying said at least one line of expanded tobacco paste to a moving web of wrapping material;

supplying a generally cylindrical tobacco rod in overlaying relationship to said at least one expanded paste line on said web of wrapping material; and, folding said web of wrapping material circumferentially around said tobacco rod.

14. A process of manufacturing a cigarette comprising the steps of:

forming an expandable tobacco paste comprised of tobacco material and a rising component;

disposing a bed of tobacco on a moving web of wrapping material;

concurrently expanding said expandable tobacco paste and extruding at least one line of expanded tobacco paste;

applying said at least one line of expanded tobacco paste to the bed of tobacco moving with the web of wrapping material; and, folding said web of wrapping material to enclose said tobacco bed.

* * * * *